United States Patent [19]

Miner

[11] 4,025,991

[45] May 31, 1977

[54] BELT BUCKLE

[76] Inventor: Charles M. Miner, 2807 S. Millwood, Wichita, Kans. 67217

[22] Filed: Nov. 20, 1975

[21] Appl. No.: 633,911

[52] U.S. Cl. ..... 24/191; 24/171

[51] Int. Cl.[2] ..... A44B 11/12

[58] Field of Search ..... 24/171, 170, 168, 194, 24/196, 78, 191, 25

[56] References Cited

UNITED STATES PATENTS

| | | | |
|---|---|---|---|
| 1,416,290 | 5/1922 | Hart | 24/191 |
| 1,477,600 | 12/1923 | Shields | 24/191 |
| 1,482,209 | 1/1924 | Abraham | 24/191 |
| 1,630,758 | 5/1927 | Pfaltzgraff | 24/191 |
| 3,979,800 | 9/1976 | Masuda | 24/171 |

*Primary Examiner*—Paul R. Gilliam
*Assistant Examiner*—Kenneth J. Dorner
*Attorney, Agent, or Firm*—Robert E. Breidenthal

[57] ABSTRACT

A belt buckle comprising a channel-like shell inclusive of a web joining a pair of flanges. A slide adapted to be secured to one end of a belt is slidably mounted in the shell in spaced relation to the web for receiving the other end of the belt therebetween. A gripping member is disposed between the web and the slide and is pivoted eccentrically to the flanges. The gripping member has a tongue that operates in a slot in the slide so that belt tension moves the slide against the tongue to oscillate and force the gripping member to grip the belt between the latter and the web.

1 Claim, 6 Drawing Figures

FIG. 1
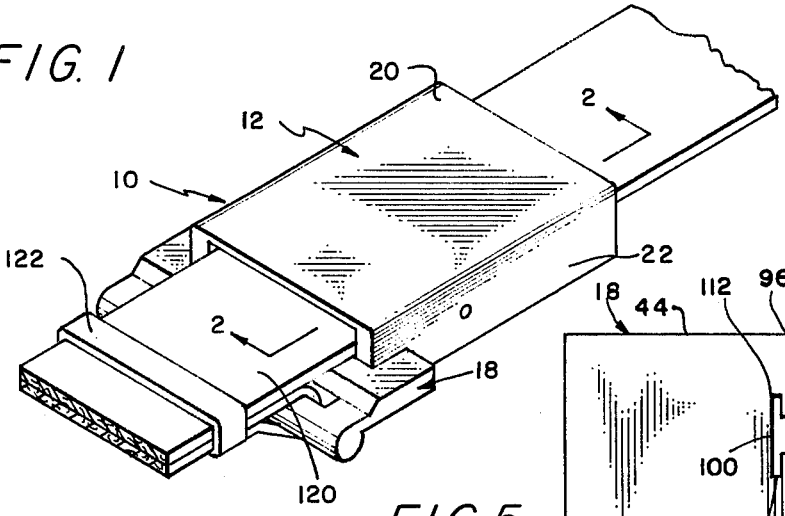
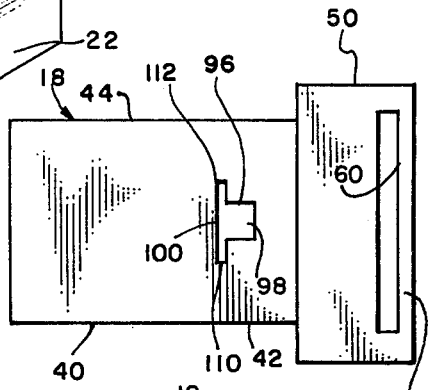
FIG. 5
FIG. 2
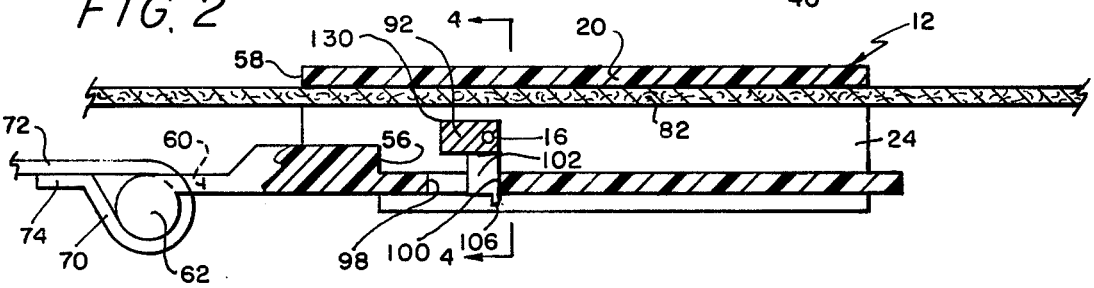
FIG. 3
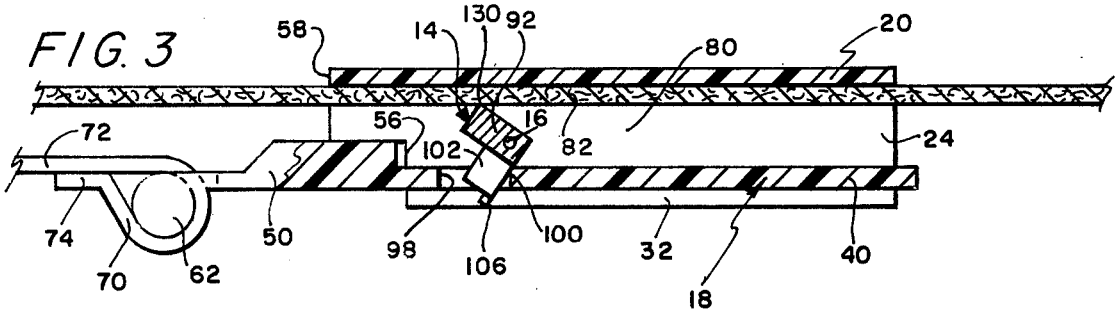
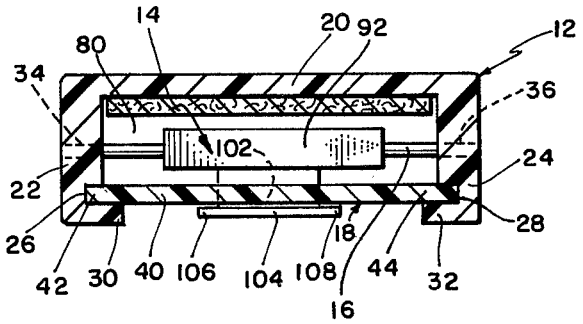
FIG. 4
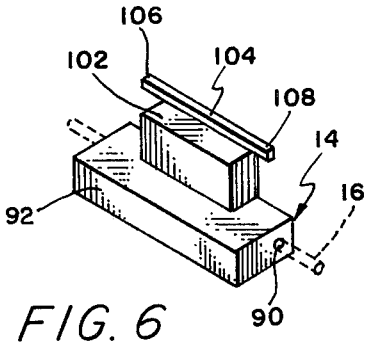
FIG. 6

BELT BUCKLE

The present invention relates to new and useful improvements in belt buckles and pertains more particularly to improved means for gripping the belt in secured position.

The primary object of the invention is to provide a highly functional ornamental belt buckle of durable character that can be inexpensively manufactured, and which does not make use of or require belt holes.

An appreciation of the state of the related art as well as an enhanced comprehension of the character of objectives sought to be achieved can be obtained on consideration of the following United States Letters Patent:

1,482,209 Abraham; Jan. 29, 1924
1,591,702 Gisske; July 6, 1926
1,877,416; Matheus; Sep. 13, 1932
2,020,371 Nagel; Nov. 12, 1935
2,197,535 Barett; Apr. 16, 1940
2,634,483 Whitehouse; Apr. 14, 1953
2,767,453 Sauer; Oct. 23, 1956
3,191,253 Stevenson; June 29, 1965

Broadly, the present invention relates to a belt buckle comprising a longitudinally extending channel-shaped shell that includes a web joining a pair of flanges, a slide and means mounting the slide within the shell in spaced relation to the web for sliding movement substantially parallel to the longitudinal extent of the shell, said slide, web and flanges defining a longitudinally extending space of generally rectangular transverse configuration for commodiously accommodating insertion of a belt therethrough, a gripping member disposed in said spaced in spaced relation from the web, said gripping member being eccentrically and pivotally connected to the flanges for oscillation about an axis parallel to the web and normal to the longitudinal extent of the shell, the arrangement being such that oscillation of the gripping member in one direction from a release position thereof reduces the spacing between the gripping member and the web in an arrangement adapted to grip a belt between the web and the gripping member, means operatively interconnecting the slide and the gripping member for oscillating the gripping member in said one direction and in the opposite direction respectively in response to the slide moving in first and second opposite directions relative to the shell.

The invention will be best understood in the light of the following description of a preferred embodiment thereof, the same being given relative to the accompanying drawings illustrative thereof, wherein:

FIG. 1 is an isometric view of the belt buckle, the same being shown in operative association with a partially shown belt;

FIG. 2 is an enlarged longitudinal sectional view taken upon the plane of the section line 2—2 in FIG. 1, the slide and gripping member being shown in belt releasing position;

FIG. 3 is a view similar to FIG. 2, however, this view shows the slide and gripping member in belt gripping or securing position;

FIG. 4 is a transverse sectional view taken upon the plane of the section line 4—4 in FIG. 2;

FIG. 5 is a plan view on reduced scale of the slide; and,

FIG. 6 is an enlarged isometric view of the gripping member, the same being shown in association with the pivot pin, with the latter being shown in dashed outline.

Referring now to the drawings, wherein like numerals designate like parts throughout the various veiws, the reference numeral 10 designates the belt buckle generally, the same being comprised of a channel-shaped shell 12, a gripping member 14 and its associated pivot pin 16, and a slide 18.

The shell 12 comprises a generally planar web 20 integrally joining depending generally parallel flanges 22 and 24. As best shown in FIG. 4, the facing sides of the flanges 22 and 24 are provided with opposed longitudinally extending grooves 26 and 28 respectively, such grooves being adjacent the lower edges of the flanges 22 and 24. It will be noted that the lower edges of the flanges as well as the lower boundaries of the grooves 26 and 28 are respectively defined in part by integral inturned flanges 30 and 32. The inturned flanges 30 and 32 serve to strengthen slidable mounting of the slide 18 as will presently become evident.

The shell 12 can be made of any suitable synthetic resin or plastic as shown, or of metal. The shell can be manufactured of such plastic materials or aluminum, for example, inexpensively by extrusion techniques and cut to suitable longitudinal length, with such cutting being alternatively preceded by or followed by drilling aligned openings 34 and 36 through the flanges 22 and 24 for a purpose to be presently explained.

The slide 18 includes a gnerally planar and rectangular portion 40 having opposite side margins 42 and 44 slidably received respectively in the grooves 26 and 28, whereby the slide 18 is slidably mounted for movement in spaced parallelism to the web 20.

The slide portion 40 has longitudinal dimensions approximating that of the shell web 20, and integral therewith is an end portion 50 that projects outwardly from one end of the shell. Such portion 50 is laterally enlarged to provide shoulders 52 and 54 that are engageable against recessed shoulders 56 defined by the flanges 22 and 24 at positions spaced inwardly from the adjacent end 58 of the shell 12.

The end portion 50 of the slide is provided with a transverse slot 60 that has a bounding portion 62 of circular cross section as clearly shown in the drawings. One end 70 of a flexible belt 72 is extended through the slot 60 and about the portion 62 and suitably secured to itself in any suitable manner at 74, whereby the belt 72 is firmly attached to the slide 18.

A space 80 is defined between the slide 18 and the web 20 and the other end 82 of the belt 72 is extended through the shell 12 and the space 80, it being noted that the length of the slot 60 and the spacing of the flanges 22 and 24 are greater than the width of the belt 72.

The gripping member 14 is also disposed in the space 80 and is spaced from the flanges 22 and 24 as clearly shown in FIG. 4. The gripping member is pivotally mounted within the shell by means of the pivot pin 16 that is press fitted through an opening 90 extending through the generally rectangular parallelepiped body 92 of the gripping member 14 while being extended through the openings 34 and 36. It should be noted that the pivot pin 16 is disposed eccentrically with respect to the body 92.

Means are provided that operatively interconnect the slide 18 and the gripping member 14 in such a manner a (a) to preserve the central positioning of the latter between the flanges 22 and 24, (b) to oscillate the latter in opposite directions upon sliding movement of the slide 18 in opposite directions, and (c) to limit sliding movement of the slide 18 in opposite directions. Such interconnecting means comprises the slide 18 being provided with a "T" shaped slot 96 having opposite ends 98 and 100, with such slot 96 receiving therethrough a generally parallelepiped tongue 102 that is integral with the body 92 of the gripping member 14. The tongue 102 has an integral extension 104 having integral oppositely extending ears 106 and 108 that are disposed on the side of the slide portion 40 opposite the web 20. The "T" shaped slot 96 includes portions 110 and 112 that respectively receive the ears 106 and 108 on assembly of the tongue 102 through the slot 96, the arrangement being such as to aid in keeping the gripping member 14 and the slide 18 in assembled relation particularly as such parts are being assembled with the shell 10. Also, the ears 106 and 108 prevent release of the slide 18 and limits the oscillation of the gripping member 14.

It will be seen that the belt buckle is comprised of three parts, namely, the shell 12, the gripping member 14 and the slide 18 that are held in assembled relation by the pin 16. Assembly comprises extending the tongue 102 of the gripping member through the slot 96, and then sliding the slide 18 in the grooves 26 and 28 to place the opening 90 of the slide 18 in registry with openings 34 and 36 of the shell 12. A blocking tool, not shown, is inserted into the space 80 to prevent movement of the gripping member 14, and the pin 16 is then forced through the opening 90 to complete the buckle assembly as will be evident to those skilled in the art. On removal of the tool, the buckle is ready for attachment to the belt 72.

The use of the buckle 10 will be readily understood. With the belt 72 attached to the slide 18 as previously described, the user extends the same about his waist in the usual manner and then passes the other end portion 82 of the belt 72 through the space 80 and between the web 20 and the gripping member 14 while pushing the slide 18 toward its retracted position shown in FIG. 2. It will be noted that when the slide 18 is pushed to its retracted position, the slide 18 forces the gripping member 14 to oscillate (counterclockwise as viewed in the drawings) to a limiting belt release position such as to allow the belt portion 82 to easily pass between the gripping member 14 and the web 20. The free end portion 120 of the belt 72 can be passed through a belt loop 122 that is conventionally secured to the belt portion 70.

After the belt portion 82 has been extended through the shell 12 to the extent desired, the slide 18 is pulled to extend the same to the left as shown in the drawings and the force with which the belt portion 82 was pushed into the shell is removed, whereupon the parts assume the belt securing positions shown thereof in FIG. 2, it being noted the extension of the slide 18 and the tension of the belt 72 serve to oscillate the gripping member 14 (clockwise as viewed in the drawings) toward a limited and gripping position such that a belt engaging edge 130 of the gripping member moves toward the web 20 to engage the belt portion 82 therebetween. The engagement of the belt portion 82 with the gripping or clamping edge 130 as well as the end 100 of the slot 96 engaging the tongue 102 serve to tighten the clamping action when the belt 72 is under tension; the greater the tension, the greater the clamping action.

The belt 72 can be released by relaxing the belt tension as much as reasonably convenient while pushing the slide 18 toward the position shown thereof in FIG. 3, whereupon the gripping member 14 assumes its release position and the belt 72 can be freely withdrawn from the buckle 10.

Having fully described my invention, attention is now directed to the appended claims.

I claim:

1. A belt buckle comprising a longitudinally extending channel-shaped shell that includes a web joining a pair of flanges, a slide and means mounting the slide within the shell in spaced relation to the web for sliding movement substantially parallel to the longitudinal extent of the shell, said slide, web and flanges defining a longitudinally extending space of generally rectangular transverse configuration for commodiously accommodating insertion of a belt therethrough, a gripping member disposed in said space in spaced relation from the web, said gripping member being eccentrically and pivotally connected to the flanges for oscillation about an axis parallel to the web and normal to the longitudinal extent of the shell, the arrangement being such that oscillation of the gripping member in one direction from a release position thereof reduces the spacing between the gripping member and the web in an arrangement adapted to grip a belt between the web and the gripping member, means operatively interconnecting the slide and the gripping member for oscillating the gripping member in said one direction and in the opposite direction respectively in response to the slide moving in first and second opposite directions relative to the shell, said interconnecting means comprising a slot in said slide and a tongue on said gripping member, said tongue radially extending from the axis of the pivotal mounting of gripping member, said tongue being of a generally rectangular transverse configuration and having its major dimension parallel to said axis, and said tongue having an extension along one side thereof with such extension having a pair of ears at its extremity that extend in opposite directions toward said flanges, and said slot receiving said tongue and being of a "T"-shape in an arrangement such that the ears can engage the slide on a side thereof opposite the web.

* * * * *